US006851818B2

(12) United States Patent
Sharon et al.

(10) Patent No.: US 6,851,818 B2
(45) Date of Patent: Feb. 8, 2005

(54) ELECTROLUMINESCENT CABLE AND MOUNTING SYSTEM THEREFOR

(75) Inventors: Avraham Sharon, Lower Galilee (IL); Itzhak Hadar, Zikhron Yaakov (IL)

(73) Assignee: Teldor Wires & Cables Ltd., Kibbutz Ein Dor (IL)

( * ) Notice: Subject to any disclaimer, the term of this patent is extended or adjusted under 35 U.S.C. 154(b) by 15 days.

(21) Appl. No.: 10/432,231

(22) PCT Filed: Dec. 13, 2001

(86) PCT No.: PCT/IL01/01160

§ 371 (c)(1),
(2), (4) Date: May 22, 2003

(87) PCT Pub. No.: WO02/48605

PCT Pub. Date: Jun. 20, 2002

(65) Prior Publication Data

US 2004/0022053 A1 Feb. 5, 2004

Related U.S. Application Data

(60) Provisional application No. 60/254,935, filed on Dec. 13, 2000.

(51) Int. Cl.[7] ..... F21V 9/16

(52) U.S. Cl. ..... 362/84; 362/216; 362/225

(58) Field of Search ..... 362/84, 216, 225, 362/34, 396, 446, 253, 438, 457, 458, 551, 581; 40/542, 544; 428/917, 690; 349/69

(56) References Cited

U.S. PATENT DOCUMENTS 3,819,973 A 6/1974 Hosford
5,485,355 A * 1/1996 Voskoboinik et al. ..... 362/84
5,869,930 A 2/1999 Baumberg et al.
5,876,863 A 3/1999 Feldman et al.
6,074,071 A * 6/2000 Baumberg et al. ..... 362/582
D457,299 S 5/2002 Bruce et al.
6,686,064 B2 * 2/2004 Nakamura ..... 428/690
6,742,909 B2 * 6/2004 Conti et al. ..... 362/84

FOREIGN PATENT DOCUMENTS

JP 410240181 9/1998
WO WO 01/41511 6/2001

* cited by examiner

*Primary Examiner*—Thomas M. Sember
*Assistant Examiner*—Bao Q. Truong
(74) *Attorney, Agent, or Firm*—G.E. Ehrlich (1995) Ltd.

(57) ABSTRACT

An electroluminescent cable includes a plurality of strands extending along the length of the cable, with the outer surfaces of adjacent strands in contact with each other. At least one strand is of high tensile strength, and at least one other strand is of high light-conductivity. The strands have non-planar outer surfaces to define a recess extending along the length of the cable between the outer contacting surfaces of two adjacent strands. The cable further includes at least one electroluminescent fiber disposed in the recess between, and being in contact with, the outer contacting surfaces of two adjacent strands; and an outer light-conductive jacket enclosing the plurality of strands and the electroluminescent fiber. The outer light-conductive jacket may be integrally formed with a mounting flange extending along its length for mounting the electroluminescent cable.

20 Claims, 8 Drawing Sheets

ELECTROLUMINESCENT CABLE AND MOUNTING SYSTEM THEREFOR

This application claim the benefit of provisional application No. 60/254,935 filed Dec. 13, 2000.

FIELD AND BACKGROUND OF THE INVENTION

The present invention relates to electroluminescent cables, namely to cables which include electroluminescent fibers having a phosphor which generates light when subjected to an electrical field. The invention also relates to mounting systems for such cables.

Electroluminescent cables are well known and are gaining increasing usage where it is desired to produce a linear light source for various purposes, such as for marking-off predefined areas, for building decoration, for advertising, for providing lighted directions, names, etc. Many electroluminescent cable constructions are described in the literature, for example, in U.S. Pat. Nos. 3,819,973; 5,869,930; and 5,876,863; and in International Application PCT/NL00/00895 published Jun. 7, 2001 as International Publication No. WO 01/41511. The contents of the foregoing publications are incorporated herein by reference. However, efforts are continually being made to design electroluminescent cables of a more simplified and compact construction having greater tensile strength, higher light outputs, and/or simpler ways of mounting the cable.

OBJECTS AND BRIEF SUMMARY OF THE PRESENT INVENTION

An object of the present invention is to provide an electroluminescent cable having advantages in one or more of the above respects. Another object of the invention is to provide an electroluminescent cable of a simplified compact construction and having relatively high tensile strength and high light output for the size of the cable. A further object of the invention is to provide an electroluminescent cable construction which facilitates mounting the cable for use.

According to one aspect of the present invention, there is provided an electroluminescent cable, comprising: a plurality of strands extending along the length of the cable, with the outer surfaces of adjacent strands in contact with each other; at least one strand of the plurality being of high tensile strength, and at least one other strand of the plurality being of high light-conductivity; the strands having non-planar outer surfaces to define a recess extending along the length of the cable between the outer contacting surfaces of two adjacent strands; at least one electroluminescent fiber, the electroluminescent fiber being disposed in the recess between, and being in contact with, the outer contacting surfaces of two adjacent strands; and an outer light-conductive jacket enclosing the plurality of strands and the at least one electroluminescent fiber.

In some preferred embodiments of the invention described below, the cable consists of only two strands, one being of high tensile strength and the other being of high light-conductivity, and only one electroluminescent fiber, which is located along the recess defined by the outer contacting surfaces of the two adjacent strands. In these described preferred embodiments, the strands are of circular cross-section, and the strand of high tensile strength is of smaller diameter than that of high light-conductivity.

In another described preferred embodiment, the cable includes at least three of the strands all of having both high tensile strength and high light-conductivity, and at least three of the electroluminescent fibers. Preferably, in this described preferred embodiment, the strands are all of the same diameter, and the electroluminescent fibers are of a smaller diameter (or traverse dimension, when not circular) than the diameter of the strands.

According to another aspect of the invention, there is provided an electroluminescent cable, comprising: at least one strand of high tensile strength extending longitudinally of the cable; at least one electroluminescent fiber extending longitudinally of the cable; and an outer light-conductive jacket enclosing the at least one strand and the at least one electroluminescent fiber; the outer light-conductive jacket being integrally formed with a mounting flange extending along the length of the cable.

According to further features in that described embodiment, the mounting flange is integrally formed with an enlarged outer edge for engagement by a plurality of mounting brackets for mounting the electroluminescent cable.

According to a further aspect of the invention, the cable includes a plurality of electroluminescent sections electrically connected with, and alternating between, a plurality of electrical conductor sections; the electroluminescent sections including the at least one electroluminescent fiber; the electrical conductor sections including electrical wires for electrically interconnecting the electroluminescent sections, such that the cable serves as an interrupted linear light source having a plurality of sections producing light alternating between sections not producing light.

In the latter described embodiment, each of the electroluminescent sections is electrically connected to an electrical conductor section by a splicing unit which is integrally formed with a mounting member for mounting the electroluminescent cable.

As will be described more particularly below, the foregoing features permit electroluminescent cables to be produced having a relatively simple construction of high tensile strength and of high light-producing capabilities, and also having a convenient mounting capability facilitating the mounting of such cables for a wide variety of applications.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
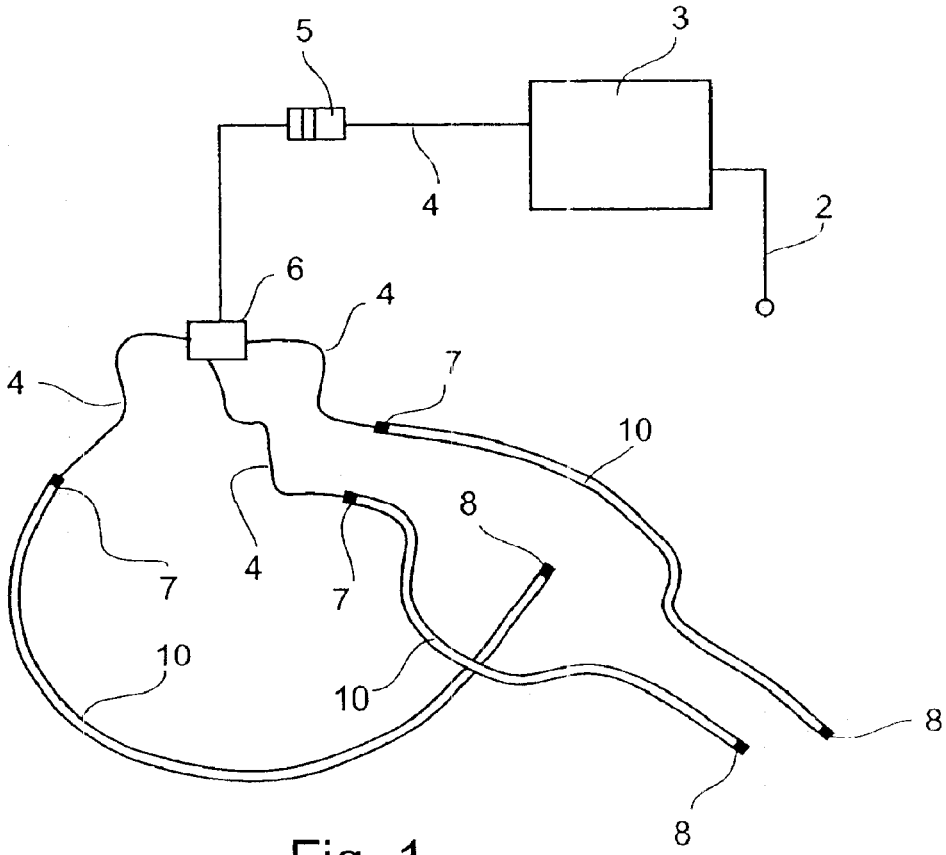
FIG. 1 diagrammatically illustrates one electroluminescent cable system constructed in accordance with the present invention.

FIG. 1 schematically illustrates a linear-lighting system including a plurality of electroluminescent cables constructed in accordance with the present invention. Such a lighting system as shown in FIG. 1 includes an electrical power supply cable 2 feeding an inverter 3 which supplies an AC voltage, via conductors 4, connector 5, and junction box 6, to a plurality of electroluminescent cables, each generally designated 10. FIG. 1 schematically illustrates three such electroluminescent cables 10 each connected at one end by an electrical conductor 4 to the junction box 6 via a splicing device 7. The opposite end of each electroluminescent cable 10 is closed by a sealing cap 8 to prevent leakage of the phosphor material included within the electroluminescent cable.

Figures 2A, 2B, 2C:
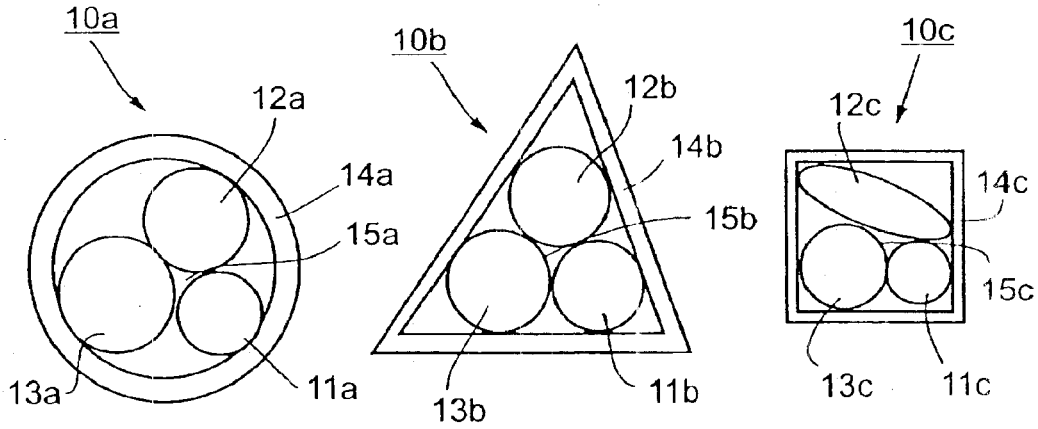
FIGS. 2*a*, 2*b* and 2*c* diagrammatically illustrate three electroluminescent cable constructions in accordance with the present invention.

FIGS. 2*a*, 2*b* and 2*c* schematically illustrate, for purposes of example, three constructions of the electroluminescent cable 10. In FIG. 2*a*, the electroluminescent cable 10, generally designated 10*a*, includes a strand 11*a* of high tensile strength, a strand 12*a* of high light-conductivity, and an electroluminescent fiber 13*a* for producing light by electroluminescence, all enclosed by an outer jacket 14*a* of light-conductive material. Strand 11*a* of high tensile strength may be of metal, such as steel, or non-metal, such as nylon, and contributes axial strength to the electroluminescent cable 10*a*. Strand 12*a* is preferably of a transparent material, which may be clear or colored, and disperses the light generated by the electroluminescent fiber 13*a*. Electroluminescent fiber 13*a* includes a phosphor located between two electrodes to generate light when a voltage is applied between the electrodes. It may be of either of the constructions illustrated in FIGS. 3*a* and 3*b*, to be described more particularly below.

FIG. 2*a* illustrates the high tensile strength strand 11*a* and the light-conductive strand 12*a* as being of circular cross-section, with strand 11*a* being of smaller diameter than strand 12*a*. These two strands are in contact with each other along the length of the cable 10*a* such that their outer surfaces define a recess 15*a* extending along the length of the cable. The electroluminescent fiber 13*a* is also of circular cross-section and is dispersed along the recess 15*a* to thereby define a compact structure with the two strands 11*a* and 12*a* and the enclosing outer jacket 14*a*, which is also of circular cross-section.

FIG. 2*b* illustrates an alternative construction for the electroluminescent cable, therein generally designated 10*b*. This construction also includes the same basic elements, namely a strand 11*b* of high tensile strength, a strand 12*b* of high light-conductivity, and an electroluminescent fiber 13*b*, all enclosed by an outer light-conductive jacket 14*b*. In the construction illustrated in FIG. 2*b*, the two strands 11*b* and 12*b* are also of circular cross-section and define, between their contacting surfaces, a recess 15*b* extending along the length of the cable and along which the electroluminescent fiber 13*b*, also of circular cross-section, is disposed. However, in the construction illustrated in FIG. 2*b*, the light-conductive jacket 14*b* is of a non-circular cross-section being triangular in this case. This enables the electroluminescent cable 10*b* may be laid flat, or otherwise mounted, along any one of its three sides with a selected side facing outwardly, as may be desired according to a particular application.

In FIG. 2*c*, the electroluminescent cable, therein generally designated 10*c*, also has the same basic construction as described above with respect to FIG. 2*a*, in that it includes the high-tensile strand 11*c*, light-dispersing strand 12*c*, and an electroluminescent fiber 13*c*, all enclosed within an outer light-conductive jacket 14*c*. In this case, however, the light-dispersing strand 12*c* is of non-circular cross-section, being shown as of an elliptical cross-section, to produce the desired dispersion of the light from the electroluminescent fiber 13*c*. In addition, the outer light-conductive jacket 14*c* is of a rectangular configuration, to enable the electroluminescent cable to be mounted with any one of its four sides facing outwardly, as may be desired for any particular application.

Figure 3A:
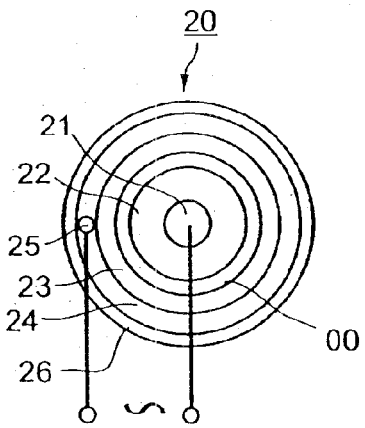
FIGS. 3*a* and 3*b* diagrammatically illustrate two constructions of electroluminescent fibers, namely, a one-filament fiber and a two-filament fiber, which may be included in the electroluminescent cables of FIGS. 2*a*–2*c* or the other electroluminescent cables described below.
Figure 3B:
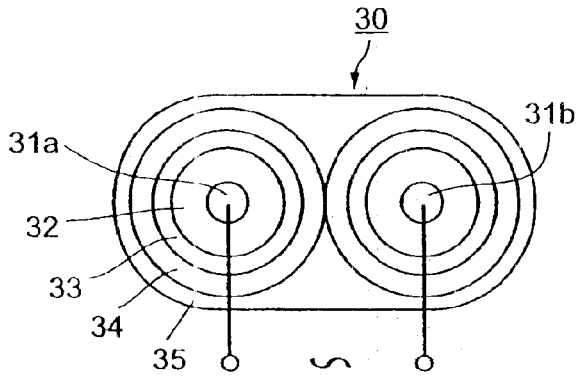

The electroluminescent fiber 13*a*–13*c* in FIGS. 2*a*–2*c*, respectively, may be of any desired construction. FIGS. 3*a* and 3*b* illustrate two known constructions, but it will be appreciated that any other desired construction, such as those described in the above-cited patents, may be used.

FIG. 3*a* illustrates a single-filament construction, generally designated 20. It includes a central wire conductor 21 serving as the inner electrode, an insulating layer 22 thereover, a phosphor layer 23 over the insulating layer, and a layer 24 of transparent material and of high-electrical conductivity serving as the outer electrode of the electroluminescent fiber. Layer 24 is electrically connected to one side of a voltage source by a wire 25 in electrical contact with that layer, and the opposite side of the voltage source is connected to the inner electrode 21, to produce the electrical field for creating luminescence in the phosphor layer 23. The illustrated electroluminescent fiber further includes an outer light-conductive jacket 26 of uncolored or colored transparent plastic material to permit transmission therethrough of the light generated within the electroluminescent fiber.

FIG. 3*b* illustrates a two-filament construction of electroluminescent fiber, therein generally designated 30. In this case, there are two wire electrodes, 31*a*, 31*b*, each constituting one of the two filaments of the cable. Filament 31*a* further includes an insulating layer, phosphor layer, and a transparent electrically-conductive layer 34. Filament 31*b* is similarly constructed. As shown in FIG. 3*b*, the voltage is applied between the two filaments 31*a*, 31*b*. The outer light-conductive jacket 36, encloses both of filaments to produce a relatively flat electroluminescent fiber having two light-generating filaments therein, thereby producing a higher light output.

The foregoing single-filament and two-filament constructions of FIGS. 3*a* and 3*b*, respectively, are well known as described, for example, in the above-cited U.S. Pat. No. 5,869,930. As indicated above, any other suitable electroluminescent fiber construction may be used in the electroluminescent cable as described above, and also to be described below.

Figure 4:
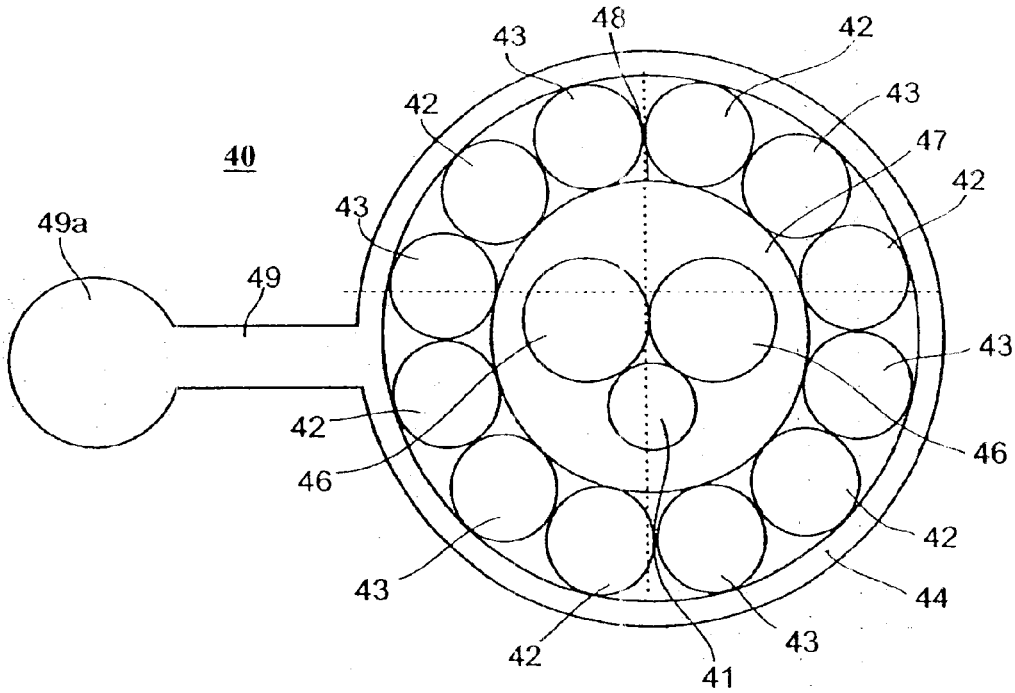
FIG. 4 diagrammatically illustrates another electroluminescent cable in accordance with the present invention particularly facilitating its mounting.

FIG. 4 illustrates another construction of electroluminescent cable, therein generally designated 40. This construction also includes, among other elements, a strand 41 of high tensile strength, a strand 42 of high light-conductivity, and an electroluminescent fiber 43, all enclosed by an outer light-conductive jacket 44. In this case, however, the high tensile strength strand 41 is located in the central region of the cable, and there are a plurality of the light-conductive strands 42 and a plurality of the electroluminescent fibers 43 in the outer peripheral region of the cable alternatingly arrayed with respect to each other. The illustrated cable further includes two insulated conductors 46 in the central region of the cable for providing power or communication paths through the electroluminescent cable.

As more particularly shown in FIG. 4, cable 40 includes the two insulated electrical conductors 46 and the high tensile strength strand 41 all embedded within insulating material 47, such as PVC, to constitute the central core of the cable. This central core is enclosed by a light-reflective layer 48, such as a light-reflecting film or coating applied over the central core. A plurality of the light-conductive strands 42 and electroluminescent fibers 43 are applied over the light reflective layer 48 in an alternating relationship to each other. In the example illustrated in FIG. 4, there are six light-conductive strands 42 and six electroluminescent fibers 43 applied over the outer surface of the light-reflective layer 48, all enclosed by the outer light-conductive jacket 44.

The high tensile strength strand 41, the light-conductive strands 42, and the electroluminescent fibers 43, preferably extend in a twisted relationship to each other along the length of the cable. However, such strands and fibers could also extend in a parallel relationship to each other. It will be appreciated that the other electroluminescent cable constructions described herein, as well as the two-filament fiber constructions of FIG. 3*b*, could have either a parallel or a twisted arrangement.

In the electroluminescent cable 40 illustrated in FIG. 4, the outer light-conductive jacket 44 is integrally formed with a mounting flange 49, having an enlarged outer edge defining a circular bead 49*a*, for mounting the cable in the manner to be described more particularly below with respect to FIGS. 8*a*–8*c*.

Figure 5:
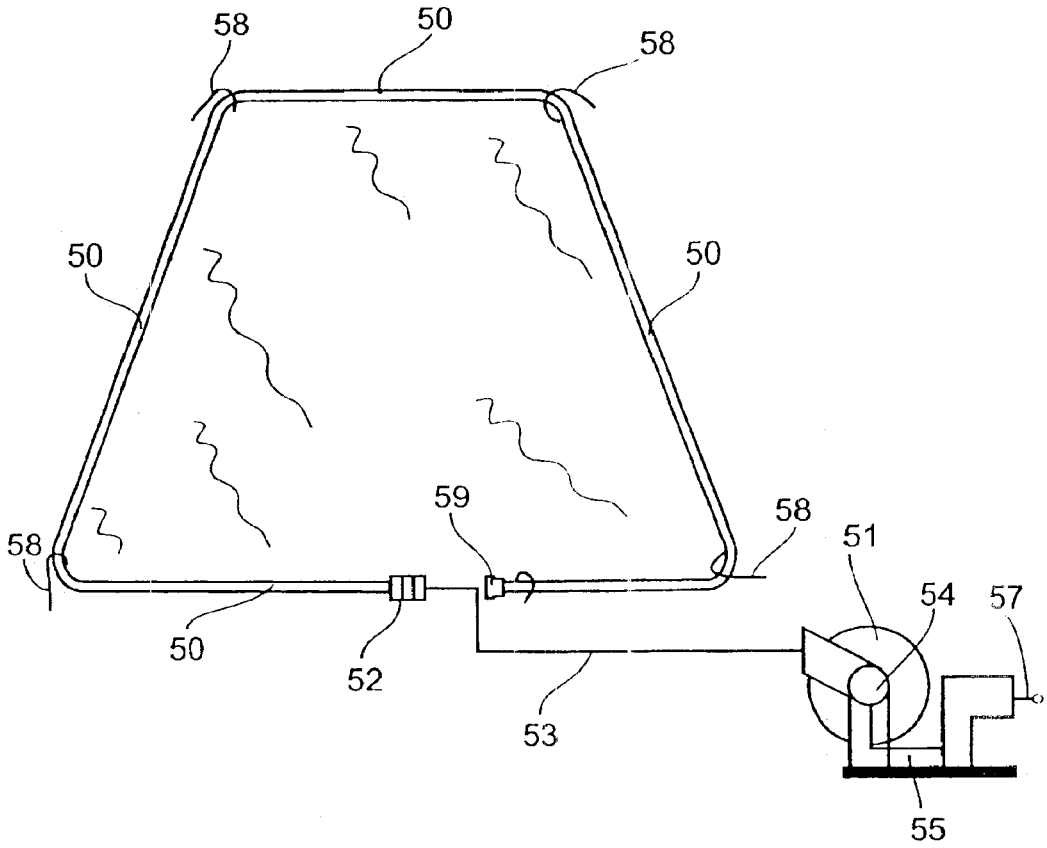
FIG. 5 diagrammatically illustrates a portable electroluminescent lighting system, e.g., for marking-off various areas, such as a helicopter landing site, by linear light sources constituted of electroluminescent cables constructed in accordance with the present invention.

FIG. 5 schematically illustrates a portable lighting system including an electroluminescent cable constructed in accordance with the present invention to enable it to be transported to any desired site and deployed thereat for marking-off a particular area. The portable system illustrated in FIG. 5 includes an electroluminescent cable 50, according to any of the constructions described above, wound on a reel 51 for convenient transportation. One end of the electroluminescent cable 50 is electrically coupled via a connector 52, conductor 53, rotary joint 54, and another conductor 55, to an inverter 56 supplied from a power supply conductor 57. Inverter 56 produces the AC voltage applied to the two electrodes within the electroluminescent cable for generating the linear light by electroluminescence.

Electroluminescent cable 50 may be mounted or fixed in any desired configuration by mounting elements, schematically shown at 58 in FIG. 5, to provide a linear light source for marking-off an area of any desired configuration. The configuration illustrated in FIG. 5 for purposes of example is that for a helicopter landing pad.

As also shown in FIG. 5, the distal end of the electroluminescent cable 50 is sealed closed by a sealing end cap 59 to prevent loss of the phosphor material within the cable.

Figure 6:
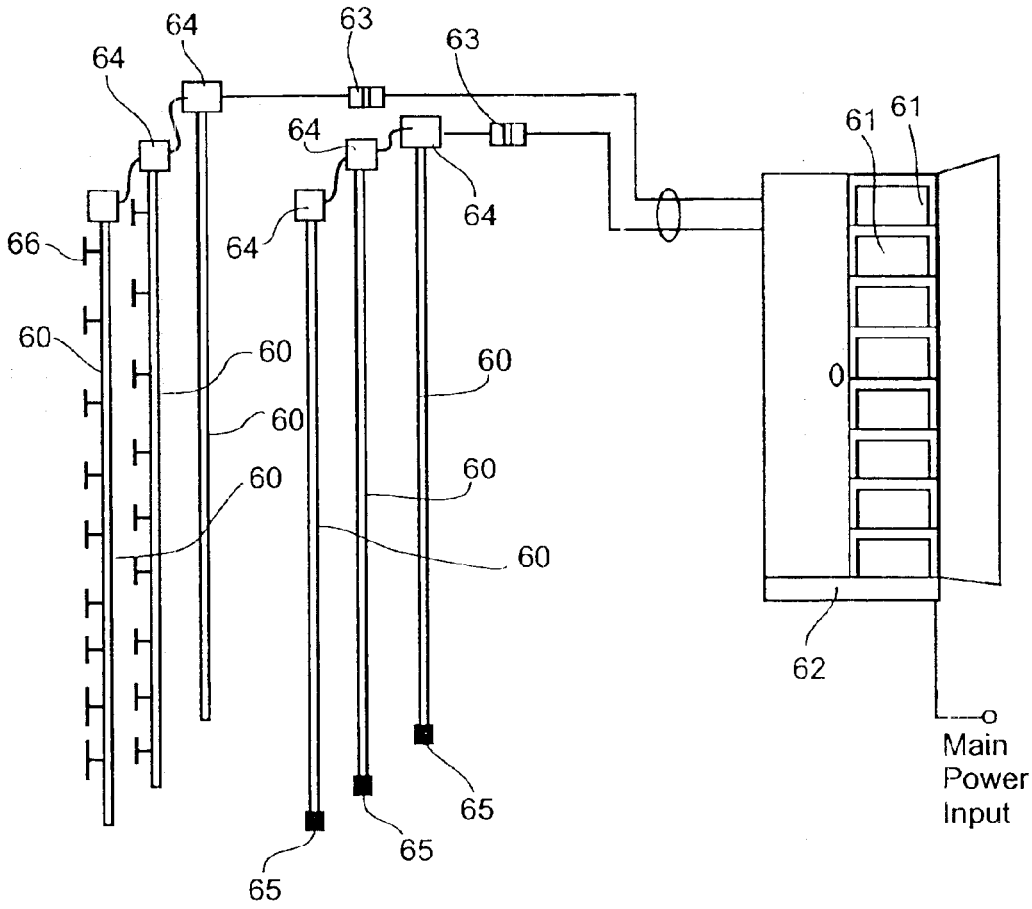
FIG. 6 diagrammatically illustrates another possible application of electroluminescent cables in accordance with the present invention, namely for building decorations.

FIG. 6 schematically illustrates a lighting system including a plurality of electroluminescent cables 60 to be mounted on a building or other structure for decoration, advertising, directional, or other purposes. In the system illustrated in FIG. 6, each of the electroluminescent cables 60 is supplied from an inverter 61 having a common power supply 62. Cables 60 are connected to their respective inverters 61 by connectors 63 and juncture boxes 64. Each cable 60 is also sealed at its distal end by a sealing cap 65 and may be mounted by mounting elements 66.

Figure 7A:
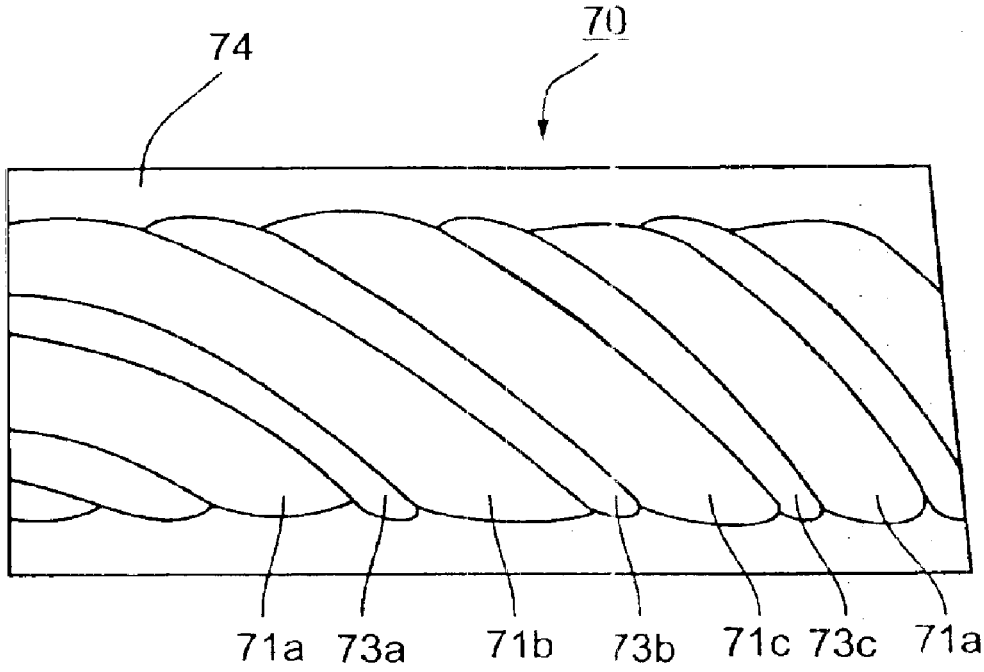
FIG. 7*a* is longitudinal fragmentary view illustrating another electroluminescent cable constructed accordance with the present invention.
Figure 7B:
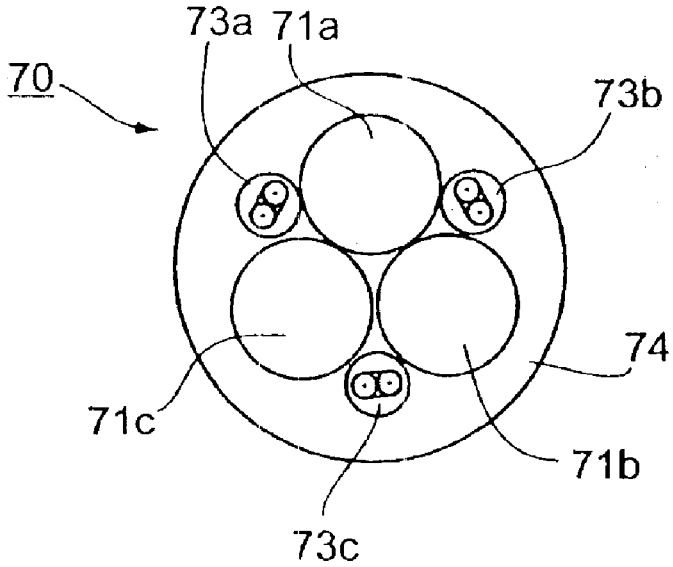
FIG. 7*b* is an end view of the electroluminescent cable.

FIGS. 7*a* and 7*b* illustrate another construction of electroluminescent cable in accordance with the present invention. The illustrated electroluminescent cable, generally designated 70, includes three strands 71*a*, 71*b*, 71*c*, all made of a material which has both high tensile strength and high light-conductivity. Thus, all three strands 71*a*–71*c* serve both the high strength and the high light-conductivity functions of the electroluminescent cables described above with respect to FIGS. 2*a*–2*c*, namely with respect to strands 11*a*–11*c* and 12*a*–12*c*. The cable illustrated in FIG. 7*a* and 7*b* also includes three electroluminescent fibers, shown at 73*a*–73*c*, respectively, each located along a recess 75*a*–75*c*, respectively, between, and in contact with, the outer contacting surfaces of two adjacent strands.

The cable illustrated in FIGS. 7*a* and 7*b* also includes an outer light-conductive jacket 74 enclosing all the strands and electroluminescent fibers within the cable.

In the cable illustrated in FIGS. 7*a* and 7*b*, the electroluminescent fibers 73*a*–73*c* are of the two filament type, described above with respect to FIG. 3*b*, in order to maximize the light output capability of the cable. It will be appreciated, however, that the single-filament construction illustrated in FIG. 3*a*, as well as any other electroluminescent filament construction, could be used in this cable.

The strands 71*a*–71*c* which, as noted above, provide both high tensile strength and high light-conductivity, may be clear, or may be colored as desired, to produce the desired color of illumination.

Figure 8A:
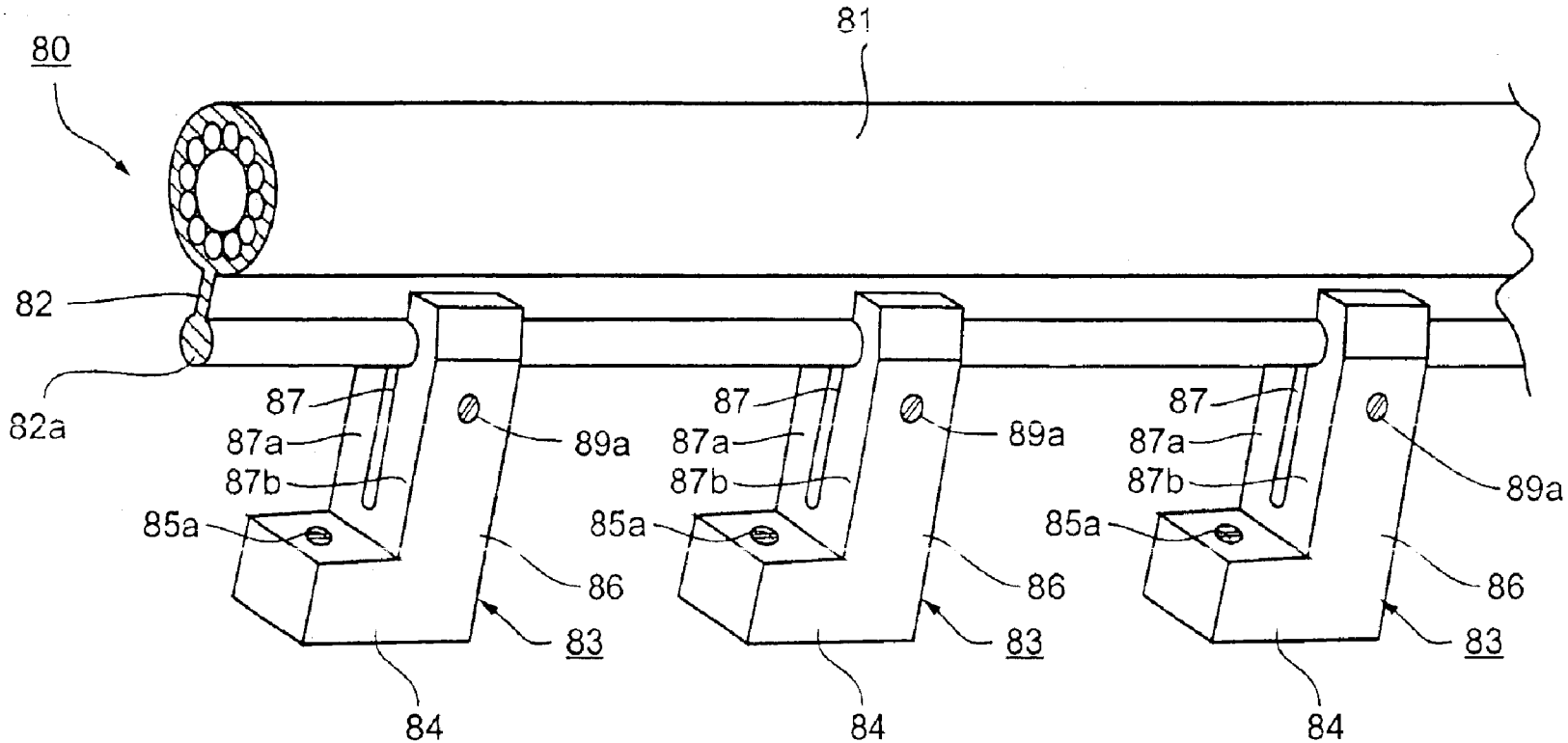
FIG. 8*a* is a three-dimensional view illustrating an electroluminescent cable, such as that shown in FIG. 4, mounted by a plurality of mounting brackets, e.g., to the wall of a building.
Figure 8B:
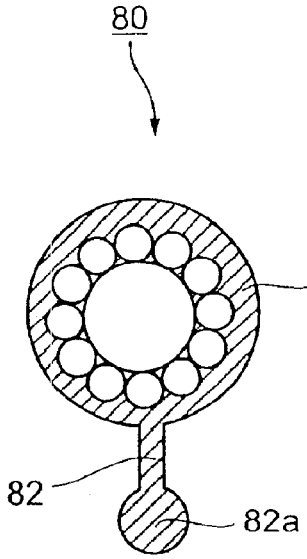
FIG. 8*b* is an end view of FIG. 8*a;*
Figure 8C:
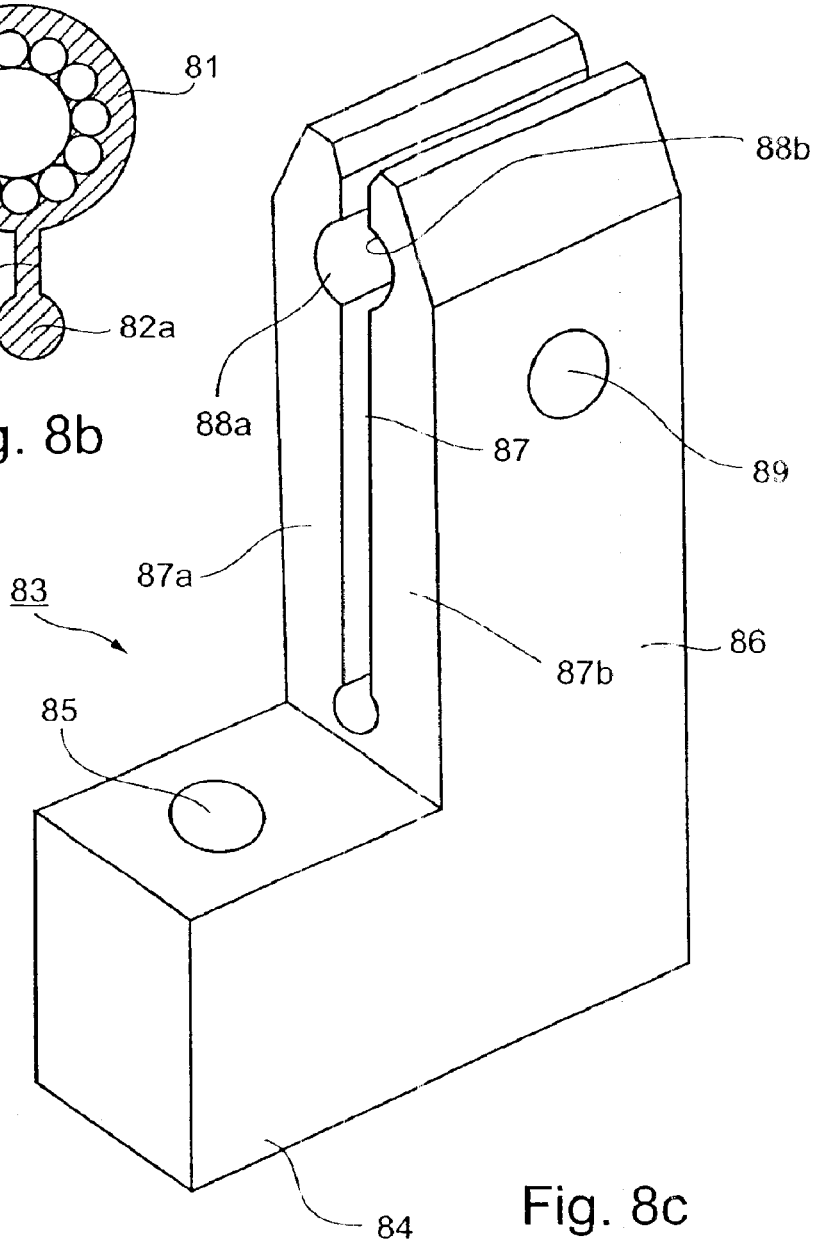
FIG. 8*c* is an enlarged three-dimensional view illustrating one of the mounting brackets in FIG. 8*a;*

FIGS. 8*a*–8*c* illustrate one mounting arrangement that may be used for mounting the electroluminescent cable shown in FIG. 4, for example, to any particular mounting structure, such as a building wall, sign, or the like. In FIGS. 8*a* and 8*b*, the electroluminescent cable is generally designated 80 and is shown, for purposes of example, as having the construction described above with respect to FIG. 4, but it will be appreciated that it could have any other construction, such as illustrated in the other drawing figures herein. As described above in FIG. 4, the outer light-conducting jacket, designated 81 in FIGS. 8*a* and 8*b*, of the cable 80 is integrally formed with a mounting flange 82 extending along the length of the cable and terminating with an enlarged outer edge 82*a* for engagement by a plurality of mounting brackets, each generally designated 83.

Each mounting bracket 83 includes a mounting leg 84 formed with a bore 85 (FIG. 8*c*) to receive a fastener 85*a* (FIG. 8*a*) for mounting the bracket. Each bracket further includes an upstanding leg 86 formed with a slot 87 to define two clamping jaws 87*a*, 87*b*. The two clamping jaws are formed with semi-circular recesses 88*a*, 88*b* at their outer ends to receive the enlarged outer edge or bead 82*a* of the mounting flange 82. The two legs 87*a*, 87*b* are further formed with a bore 89 (FIG. 8*c*) for receiving a thread fastener 89*a* (FIG. 8*a*) to firmly clamp the two jaws to the enlarged bead 82*a*.

Figure 9A:
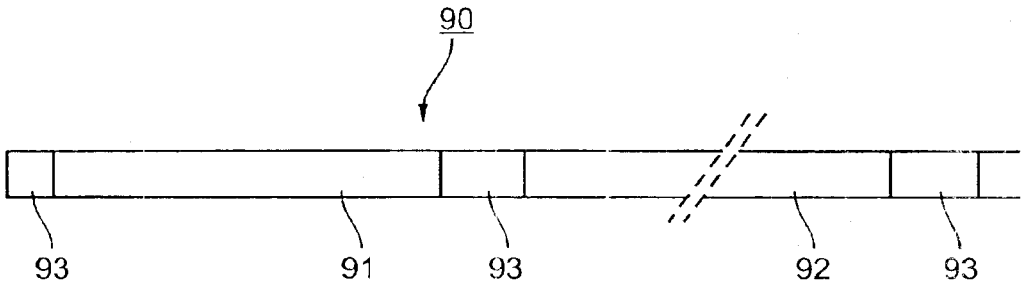
FIG. 9*a* illustrates another construction of electroluminescent cable in accordance with the present invention to serve as an interrupted linear light source, rather than as a continuous linear light source.
Figure 9B:
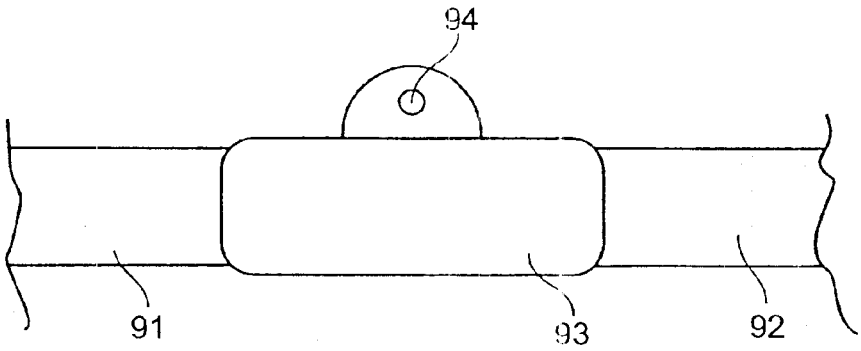
FIG. 9*b* illustrates one of the splicing and mounting units in the electroluminescent cable of FIG. 9*a* to facilitate mounting the cable.

FIGS. 9*a* and 9*b* illustrate an electroluminescent cable, generally designated 90, which includes a plurality of electroluminescent sections 91 electrically connected with, and alternating between, a plurality of electrical conductor sections 92. Each of the electroluminescent sections 91 is electrically connected to the electrical conductor sections 92 on its opposite sides by a splicing unit 93. As shown in FIG. 9*b*, splicing unit 93 is integrally formed with a mounting tab or bracket 94 for mounting the electroluminescent cable 90 as and where desired.

Such a cable as illustrated in FIGS. 9*a* and 9*b* thus produces an interrupted linear light source having a plurality of sections (91) producing light alternating with sections (92) not producing light. The electroluminescent cable 90 may be mounted as and where desired by the mounting members 95 (FIG. 9*b*) integrally formed with the splicing units 94.

While the invention has been described with respect to several preferred embodiments, it will be appreciated that these are set forth merely for purposes of example, and that many other variations, modifications and applications of the invention may be made.

What is claimed is:

1. An electroluminescent cable, comprising:

a plurality of strands extending along the length of the cable with the outer surfaces of adjacent strands in contact with each other; at least one strand of said plurality being of high tensile strength, and at least one other strand of said plurality being of high light-conductivity; said strands having non-planar outer surfaces to define a recess extending along the length of the cable between the outer contacting surfaces of two adjacent strands;

at least one electroluminescent fiber, said electroluminescent fiber being disposed along said recess between, and being in contact with, the outer contacting surfaces of two adjacent strands;

and an outer light-conductive jacket enclosing said plurality of strands and said at least one electroluminescent fiber.

2. The electroluminescent cable according to claim 1, wherein said cable consists of only two of said strands, one being of high tensile strength and the other being of high light-conductivity, said cable including only one of said electroluminescent fibers in the recess defined by the outer contacting surfaces of said two strands.

3. The electroluminescent cable according to claim 2, wherein said strands are of circular cross-section, said strand of high tensile strength being of smaller diameter than that of high light-conductivity.

4. The electroluminescent cable according to claim 1, wherein all of said strands have both high tensile strength and high light-conductivity.

5. The electroluminescent cable according to claim 1, wherein said cable includes at least three of said strands and at least three of said electroluminescent fibers.

6. The electroluminescent cable according to claim 5, wherein said strands are of the same diameter, and said electroluminescent fibers are of a smaller diameter than that of said strands.

7. The electroluminescent cable according to claim 5, wherein all of said strands have both high tensile strength and high light-conductivity.

8. The electroluminescent cable according to claim 1, wherein said strands and said at least one electroluminescent fiber extend in a twisted relation to each other longitudinally of the cable.

9. The electroluminescent cable according to claim 1, wherein said outer light-conductive jacket is integrally formed with a mounting flange extending along its length for mounting the electroluminescent cable.

10. The electroluminescent cable according to claim 9, wherein said mounting flange is integrally formed with an enlarged outer edge for engagement by a plurality of mounting brackets for mounting the electroluminescent cable.

11. The electroluminescent cable according to claim 10, in combination with a plurality of mounting brackets each having a pair of clamping jaws for clamping the enlarged outer edge of said mounting flange.

12. An electroluminescent cable, comprising:

at least one strand of high tensile strength extending longitudinally of the cable;

at least one electroluminescent fiber extending longitudinally of the cable;

and an outer light-conductive jacket enclosing said at least one strand and said at least one electroluminescent fiber;

said outer light-conductive jacket being integrally formed with a mounting flange extending along the length of the cable.

13. The electroluminescent cable according to claim 12, wherein said mounting flange is integrally formed with an enlarged outer edge for engagement by a plurality of mounting brackets for mounting the electroluminescent cable.

14. The electroluminescent cable according to claim 12, in combination with a plurality of mounting brackets each having a pair of clamping jaws for clamping the enlarged outer edge of said mounting flange.

15. The electroluminescent cable according to claim 12, wherein said cable also includes at least one strand of high light-conductivity extending longitudinally of the cable.

16. The electroluminescent cable according to claim 15, wherein said at least one strand of high tensile strength, said at least one strand of high light-conductivity, and said at least one electroluminescent fiber extend in parallel relation to each other along the length of the cable.

17. The electroluminescent cable according to claim 15, wherein said at least one strand of high tensile strength, said at least one strand of high light-conductivity, and said at least one electroluminescent fiber extend in a twisted relation to each other along the length of the cable.

18. The electroluminescent cable according to claim 15, wherein said cable includes a plurality of said strands of high light-conductivity and a plurality of said electroluminescent fibers.

19. The electroluminescent cable according to claim 1, wherein said cable includes a plurality of electroluminescent sections electrically connected with, and alternating between, a plurality of electrical conductor sections; said electroluminescent sections including said at least one electroluminescent fiber; said electrical conductor sections including electrical wires for electrically interconnecting said electroluminescent sections, such that the cable serves as an interrupted linear light source having a plurality of sections producing light alternating with sections not producing light.

20. The electroluminescent cable according to claim 19, wherein each of said electroluminescent sections is electrically connected to an electrical conductor section by a splicing unit which is integrally formed with a mounting member for mounting the electroluminescent cable.

* * * * *